US006050922A

United States Patent [19]

Wang

[11] Patent Number: 6,050,922

[45] Date of Patent: Apr. 18, 2000

[54] CASTERS FOR TREADMILL RUNNER

[76] Inventor: Leao Wang, No.1, Lane 154, Charng Long Rd., Taiping City, Taichung Hsien, Taiwan

[21] Appl. No.: 09/205,569

[22] Filed: Dec. 4, 1998

[51] Int. Cl.[7] ..... A63B 21/00

[52] U.S. Cl. ..... 482/54

[58] Field of Search ..... 482/51, 54

[56] References Cited

U.S. PATENT DOCUMENTS 5,674,453 10/1997 Watterson et al. ..... 482/54

*Primary Examiner*—Glenn E. Richman

[57] ABSTRACT

This invention primarily relates to an improvement of caster for treadmill runner which has the runner frame comprised of a master frame, a framework, a running board, a front transverse lever, a hand holder and a floor-type rear prop, etc., and focus mainly on fitting the both ends of the transverse lever horizontally installed at the base of master frame and front transverse lever an inner axle pipe individually, then socket a caster assembly having a diameter slightly bigger than lever's diameter to the inner axle pipe with a ring and a positioning pin respectively, wherein the caster assembly is comprised of an axle retainer, a caster and a pin fitting, therefore, by using the corresponding anchoring holes drilled on axle retainer and caster, the pin-anchoring portion of pin fitting can be inserted into the anchoring holes and retain the caster at the position to disable its rotation; so to speak, after the removal of pin fitting, caster is able to rotate; thus, the user can smoothly push forward the runner frame.

5 Claims, 4 Drawing Sheets

CASTERS FOR TREADMILL RUNNER

BACKGROUND OF THE INVENTION

1. Field of the Invention

This invention primarily relates to the caster structure of a treadmill runner concerning its pushing motion. As for a better description, this newly invented structure can let runner's frame be pushed to slide directly after pack its running board and framework to their upright folding position.

2. Description of the Prior Art

The said treadmill runner is a track-type sport facility used for indoor exercise. Its typical assembly is to have one floor-type front prop and one floor type rear prop installed at front and rear end base of the treadmill runner's framework respectively. They can set the running board to demonstrate a slightly tilt status and stick to ground (standby position for immediate use) when the placement of framework is done. At this moment, user can run on the running track to do the running exercise. When storage or transportation of this treadmill runner by folding it is desired, user can flip the runner board into an upright folding position and lessen its space occupation largely.

Thus, take the precedent of consuetudiary patent U.S. Pat. No. 5,676,624 for example, (as shown on FIG. 1), after running board 12 is lifted in a vertical status, its floor-type front prop 14 will become the supporting point and will bear the total weight of runner frame 10. Afterward, there are caster assemblies 16 equipped to one suitable side of floor-type prop 14 and installed at its both ends individually. Therefore, when pushing runner frame 10 to move is desired, this can be done by just simply slanting runner frame 10 in an adequate angle and letting caster assemblies touch floor 18 to perform their works (as shown by dash line on the figure), and then smoothly pushing runner frame 10 to move.

Although the structural design of caster assemblies 16 described in the precedent of consuetudiary patent did accomplish the expected effect, however, we still can have further findings if we conduct a closer observation. Because of the integrated weight that runner frame 10 is bearing is not a light weight, also, when it is tilted to its push-to-move position, the floor-type prop 14 has completely separated from floor 18 and leaves the caster assemblies 16 as the only one supporting point. Under this circumstance, runner frame 10 may fall down to bump into the ground 18 due to user's careless incident or obstacles on the ground while user is pushing to move runner frame 10 without paying special attention to the surrounding environment. As a result, this may seriously damage the runner frame 10 and hurt the user when runner frame 10 is falling.

SUMMARY OF THE INVENTION

By taking the aforementioned facts into account, the inventor has had enthusiastically devoted himself participating into the R & D in this field. He had applied his long-term pragmatic experience as an aid to create this invention as early as expected. This invention is primarily to provide a runner frame that can let it access a free pushing movement without tilting runner frame when treadmill runner is folded in vertical status. Therefore, there will be no falling and casualty incident and the safety will be further secured during the pushing and sliding motion. This is the main objective of this invention.

BRIEF DESCRIPTION OF THE DRAWINGS

For the purpose of better understanding the technical approach and its associated characteristics of structure, a series of figures with brief description is listed below.

DETAILED DESCRIPTION OF THE PREFERRED EMBODIMENT

Figure 1:
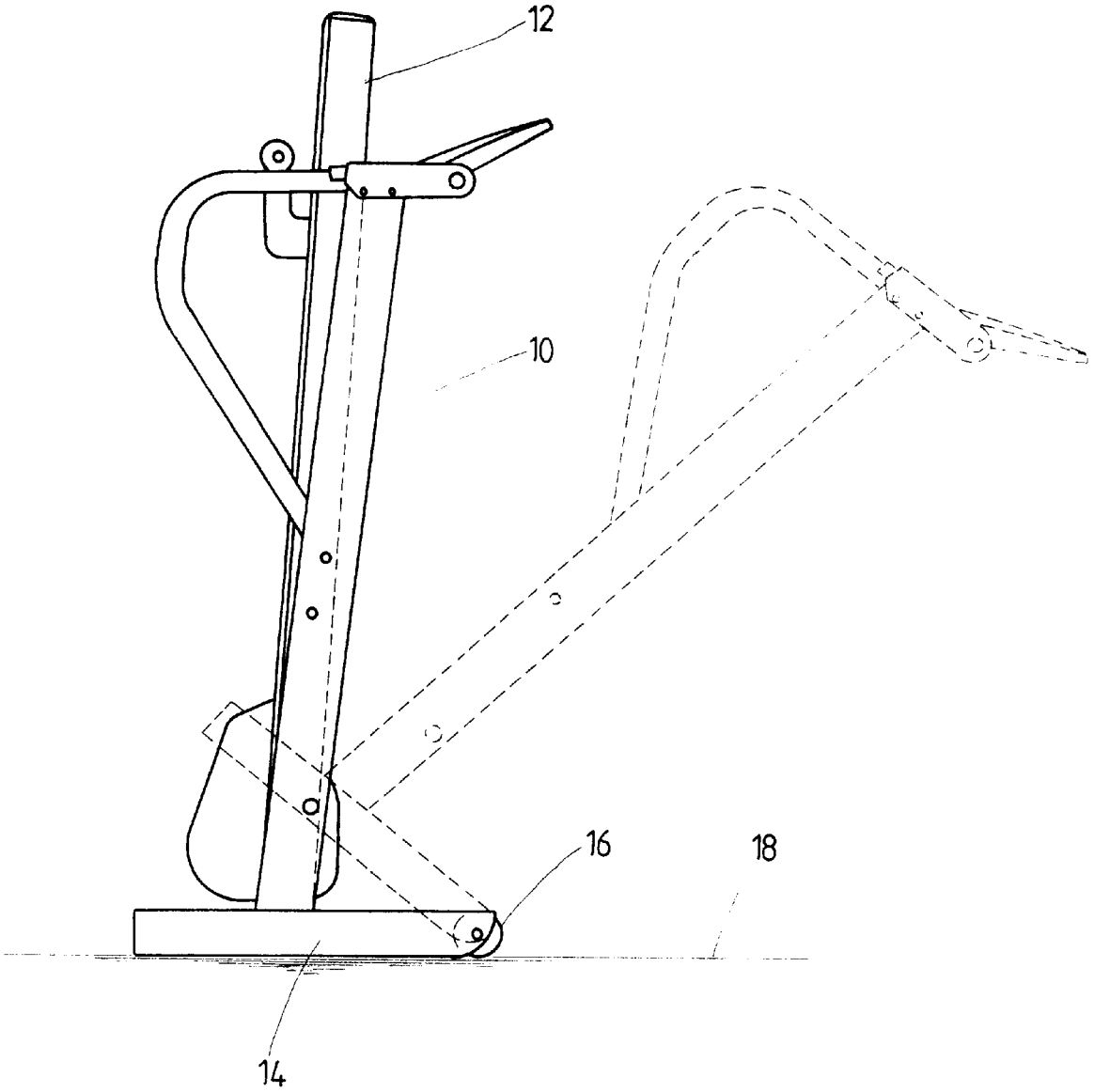
FIG.1 PRIOR ART
FIG. 1: Schematic drawing of the structure and its usage applied to the Precedent of consuetudiary patent U.S. PAT. No. 5,676,624.
Figure 2:
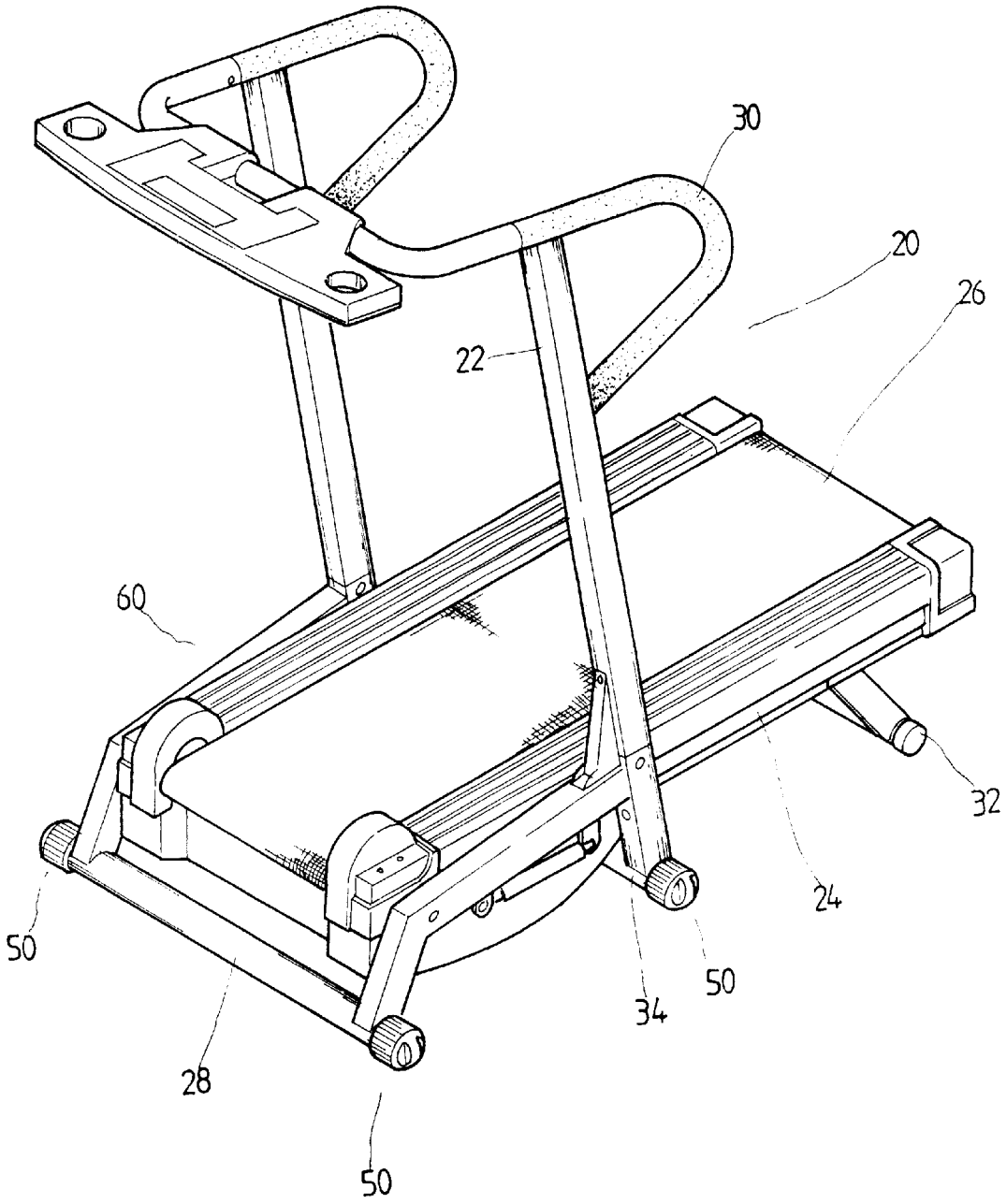
FIG. 2: 3-D Schematic drawing to show the assembly of this invention—An example of better practice.

First of all, please refer to FIG. 2, the runner frame of treadmill runner 20 comprises a master frame 22, a framework 24, a running board 26, a front transverse lever 28, a hand holder 30 and a floor-type rear prop 32, etc. A transverse lever 34 is installed transversely at the base of master frame 22 and parallel to front transverse lever 28 to form together as a supporting frame assembly 60. It can effectively and steadily support the runner frame 20 of the treadmill runner while the running board 26 and framework 24 are lifted and folded in a vertical position. Certainly this supporting frame assembly 60 can be incorporated with floor-type rear prop 32 to effectively support runner frame 20 after running board 26 and framework 24 are horizontally placed to their standby position for immediate use so that user can stand on the running board 26 and start his running exercise.

Figure 3:
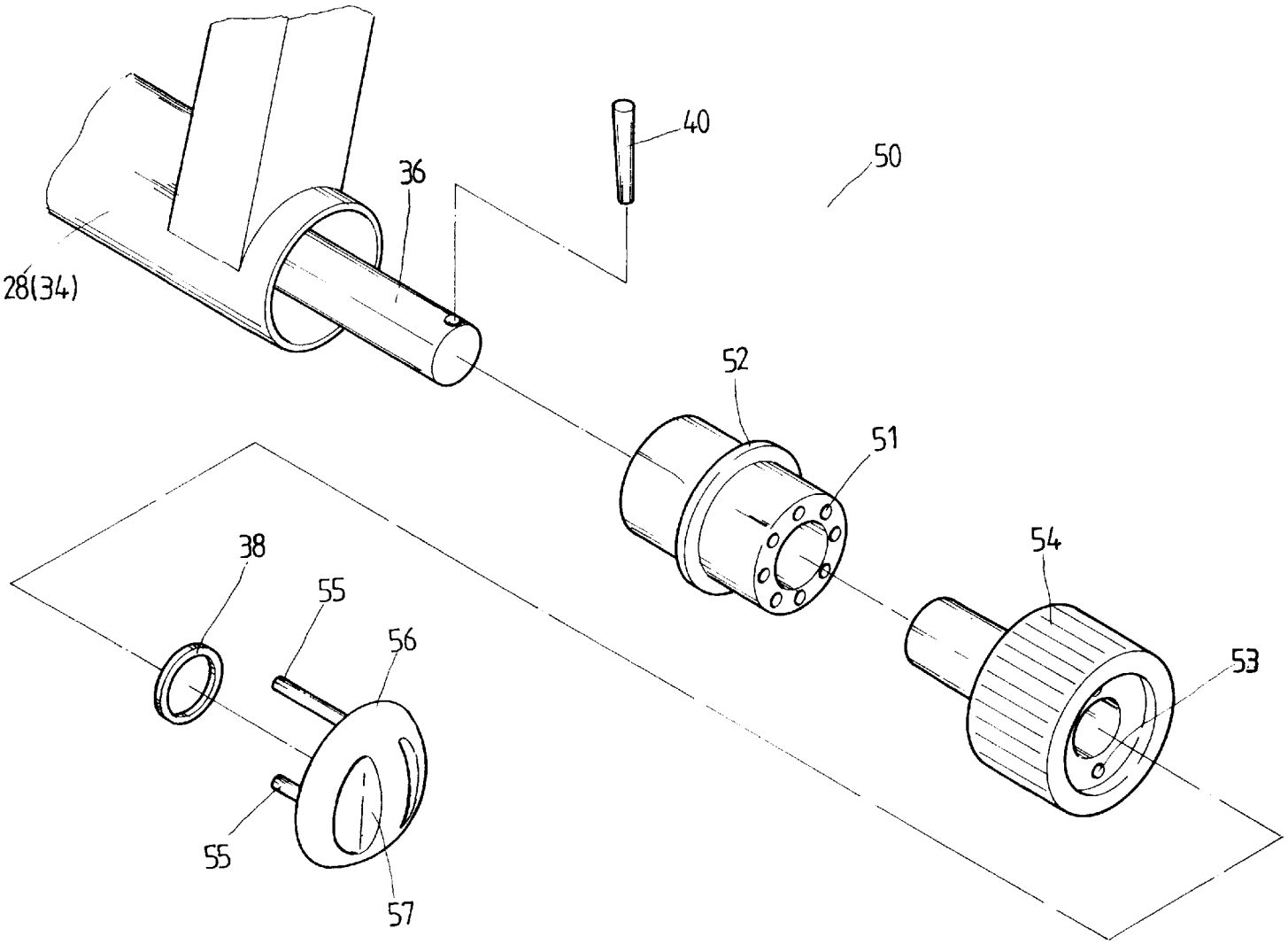
FIG. 3: 3-D Schematic drawing to show the disassembly of this invention—An example of better practice.
Figure 4:
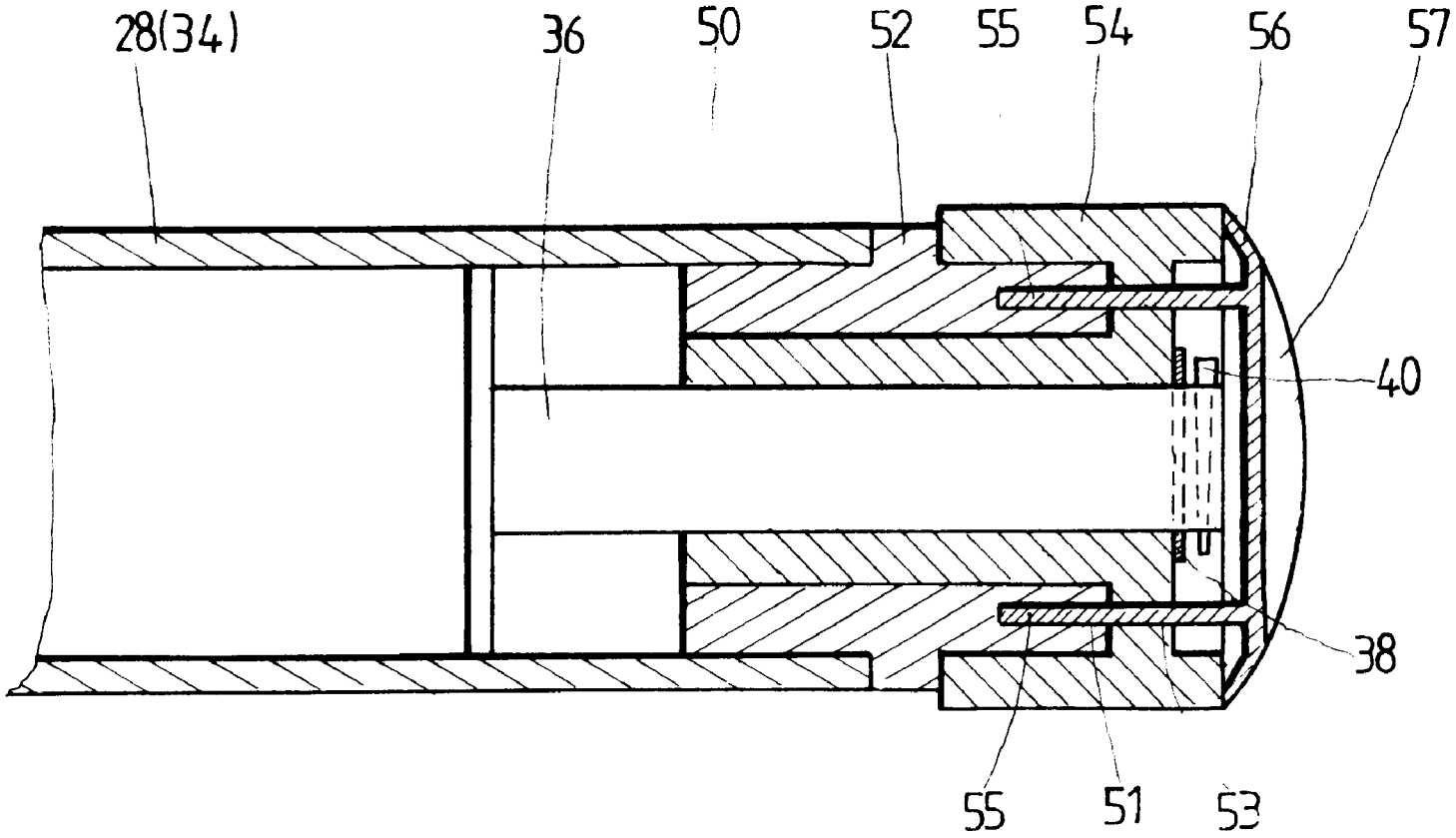
FIG. 4: Partially enlarged section view to show the assembly of this invention—An example of better practice.

Afterward, please refer to FIG. 3 and FIG. 4, this invention is primarily to fit both ends of the transverse lever 34 horizontally installed at the base of master frame 22 and front transverse lever 28 an inner axle pipe 36 individually, then socket a caster assembly 40 which has a diameter slightly bigger than lever's diameter to the inner axle pipe 36 with a ring 38 and positioning pin 40 respectively. This caster assembly 50 comprises of an axle retainer 52, a caster 54 and a pin fitting 56. etc. Therefore, by using the corresponding anchoring holes drilled on axle retainer 52 and caster 54, the pin-anchoring portion 55 of pin fitting 56 can be inserted into the anchoring holes 51 and 53 and retain the caster 54 at the position to disable its rotation. So to speak, after the removal of pin fitting 56, caster is able to rotate and enable the user to easily push forward the runner frame 20.

The axle retainer 52 of caster assembly 50 is tightly secured on inner axle pipe 36 and disabled to rotate, also there are several anchoring holes 51 drilled along the outer annulus surface of pin-anchoring portion 55 of pin fitting 56 that can easily and randomly plug into any one anchoring hole 51 to achieve the expected effectiveness after the pin-anchoring portion 55 piercing through the anchoring hole 53 of caster 54. Caster 54 is pivotally fitted to the outer periphery of axle retainer 52 to form an assembly where pivotal rotation is accessible. The number of perforating-type anchoring hole 53 at edge surface is dependent on the number of pin erected at pin-anchoring portion 55 of pin fitting 56. A lug 57 is fitted to the head of pin fitting 56 where user can hold it and apply force there by hand.

After generally and comprehensively reviewed the aforesaid content, it is concluded that there is no any other similar product circulating in the market or any publication & papers reporting the related content before the application submission of this invention. This invention fulfills the "newly invented" and "progressive" requirements with respect to its practical values. It indeed is qualified to the prerequisite required for new patent application. It should be granted the protection of patent law. An application is submitted accordingly.

I claim:

1. A treadmill runner including a framework with a movable running board, and comprising:

a) a master frame including a hand holder, the master frame connected to the framework such that the framework is movable relative to the master frame between a use position and a storage position;

b) first and second spaced apart transverse levers connected to the master frame, each of the first and second transverse levers extending transverse to the framework, the first and second transverse levers being spaced apart in a direction along a length of the framework, each first and second transverse lever having opposite end portions;

c) an axle assembly non-rotatably mounted in each end portion of each transverse lever;

d) a caster rotatably mounted on each axle assembly; and, e) a braking device removably engagable with the caster and the associated axle assembly such that, when the braking device engages the caster and axle assembly the caster is prevented from rotating and when the braking device is disengaged from the axle assembly, the caster is free to rotate, whereby the casters support the master frame when the framework is in the storage position enabling the treadmill to be moved without tilting the master frame when the braking devices are disengaged.

2. The treadmill runner of claim 1 wherein each axle assembly comprises:

a) an axle pipe mounted in the associated transverse lever and extending from the end portion thereof; and, b) an axle retainer mounted on the end portion of the associated transverse lever, the axle retainer having an outer facing annular surface adjacent to a portion of the associated caster.

3. The treadmill runner of claim 2 further comprising:

a) at least one first anchoring hole in the annular surface of the axle retainer; and, b) at least one second anchoring hole in the caster.

4. The treadmill runner of claim 3 wherein the braking device comprises a pin fitting having at least one pin anchoring portion extending therefrom and engagable with the first and second anchoring holes so as to prevent rotation of the associated caster.

5. The treadmill runner of claim 4 further comprising a lug on the pin fitting to facilitate manual manipulation of the pin fitting.

* * * * *